United States Patent [19]

Whitting

[11] 4,076,778

[45] Feb. 28, 1978

[54] CLIMBING FORMWORK

[76] Inventor: Alan Charles Whitting, 48 Chandos St., St. Leonards, Australia

[21] Appl. No.: 678,540

[22] Filed: Apr. 20, 1976

[30] Foreign Application Priority Data

Apr. 22, 1975 Australia ..... 1322/75

[51] Int. Cl.[2] ..... E04B 1/16

[52] U.S. Cl. ..... 264/33; 249/22; 264/34; 425/63

[58] Field of Search ..... 264/32, 33, 34; 249/22; 425/63, 64, 65

[56] References Cited

U.S. PATENT DOCUMENTS

| | | | |
|---|---|---|---|
| 1,887,835 | 11/1932 | Durchholz | 425/63 |
| 3,275,719 | 9/1966 | Dudson | 264/33 |

*Primary Examiner*—Thomas P. Pavelko
*Attorney, Agent, or Firm*—McGlew and Tuttle

[57] ABSTRACT

Climbing formwork for use in the erection of reinforced concrete structures in which the raising of the formwork from storey to storey is carried out by the use of movable vertically extending members the height of which when fully extended is in excess of the height of two storeys of a building to be erected, the members being maintained in their correct vertical positions by supporting tubes set into the concrete of the structure. The members carry between them beams or the like for supporting the outer forms and preferably some or all of the inner forms used for pouring the structure and are raised to a height equivalent to that of one storey of the structure after the completion of the pouring of the concrete of a storey. The vertically extending members are preferably in the form of double acting hydraulic cylinders having a piston extendable under hydraulic pressure, the extension of the piston being utilized for raising the forms. Alternatively the vertically extending members may be of constant length and raised by means of climbing jacks.

2 Claims, 29 Drawing Figures

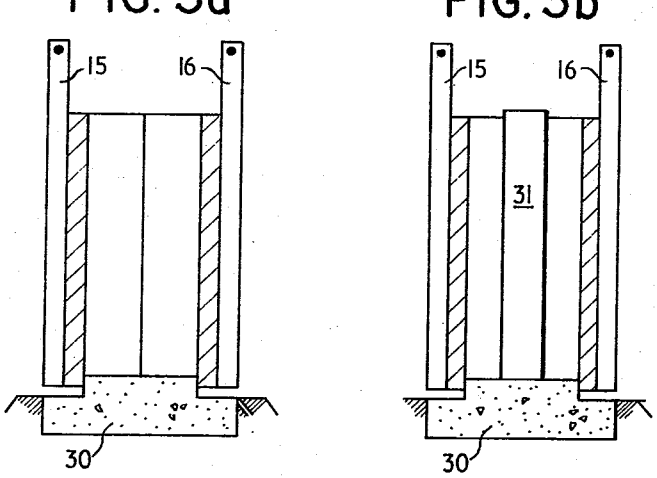
FIG. 3a
FIG. 3b
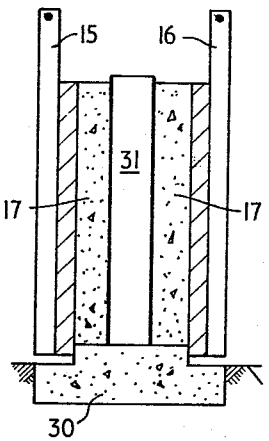
FIG. 3c
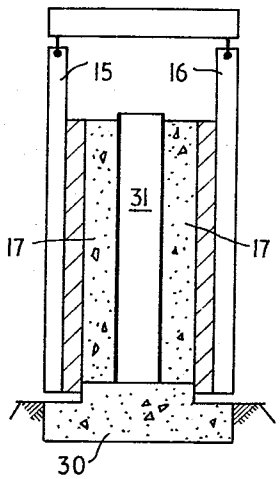
FIG. 3d

CLIMBING FORMWORK

FIELD AND BACKGROUND OF THE INVENTION

The present invention relates to climbing formwork for use in the erection of reinforced concrete structures and to a method of erecting such structures using climbing formwork.

In the erection of vertically extending reinforced concrete structures, of which the core of a multi-storey reinforced concrete building is a typical example, it is usual to use internal and external forms of a size such that they can be conveniently handled, and to erect the structure section by section moving the formwork upwardly at each section is completed. The core of such buildings is normally a more or less rectangular structure including within it a number of lift shafts, stairwells, ducts and the like. The external formwork is in the form of vertically extending sheets of a material such as plywood, the internal formwork being in the form of hollow boxes which can be collapsed inwardly to assist in stripping the form from the concrete.

One present practice is to raise the formwork section by section by means of a large crane permanently maintained on the site of the building, concrete being cast between the forms to a height corresponding to the height of one storey of the building and after the concrete has set the forms are raised by means of the crane into position to cast the next storey. An alternative procedure which avoids the necessity for the use of a crane is the "slip-form" process in which formwork of limited height is supported by supporting members set in the concrete and is carried by yokes extending from them, the formwork being continually raised as concrete is poured, the rate at which it is raised being such that the concrete will have set off sufficiently to be self supporting once the lower edge of the formwork has been raised above it.

These two systems have certain disadvantages. The maintenance of a large crane on a building site is extremely expensive both in terms of capital invested and of labor costs. While the slip-form method avoids this difficulty its nature is such that it is very difficult to produce a good and uniform finish on the concrete. It also has the disadvantage of requiring the attendance of a technician on the building site the whole time the concrete is being poured to supervise the operation of the sliding formwork.

SUMMARY OF THE INVENTION

The object of the present invention is to provide climbing formwork and a method of using same such that the use of a crane is unnecessary and which has certain advantages as compared with the slip-form method that are discussed in more detail below.

The present invention consists in climbing formwork used in the erection of reinforced concrete structures consisting of outer forms and inner forms, a plurality of vertically extending members the height of which when fully extended is in excess of the height of two storeys of the structure to be erected, these members carrying between them means for supporting the outer forms, means embedded wholly within the concrete of the structure supporting the members in a vertically upright position, this means permitting free upward movement of the whole of the members, means associated with the members for raising the outer forms after completion of a storey of the structure, means for raising the inner forms after completion of a storey of the structure, and means for raising the members vertically upwards a distance equal to the height of one storey of the structure after completion of a storey.

The invention further consists in a method of erecting a concrete structure using climbing formwork.

BRIEF DESCRIPTION OF THE DRAWINGS

In order that the invention may be better understood and put into practice a preferred form thereof is hereinafter described, by way of example, with reference to the accompanying drawings in which.

DESCRIPTION OF THE PREFERRED EMBODIMENTS

Figure 1:
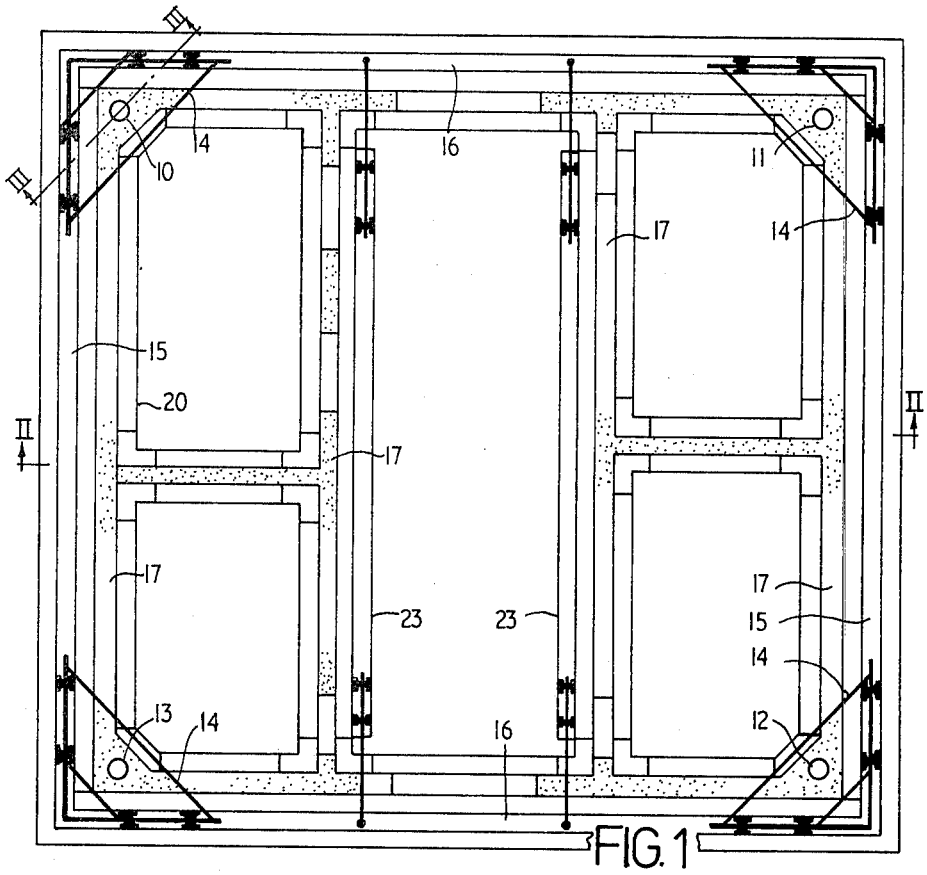
FIG. 1 is a plan view of the core of a building the design of which has been adapted for use of the present invention.

FIG. 1 shows a particular arrangement of the core of a building to provide lift shafts and other requirements. The detailed arrangements of the structure however are not of particular significance except for the fact that at each corner provision is made at points 10, 11, 12 and 13 for the accommodation in the structure of a vertically extending member 18 the nature of which is described in more detail below. Each such member thrusts against a yoke 14 which is arranged to support external forms such as 15 and 16. It will be seen from FIG. 1 that the four yokes between them support all the external forms and two internal forms.

Figure 2:
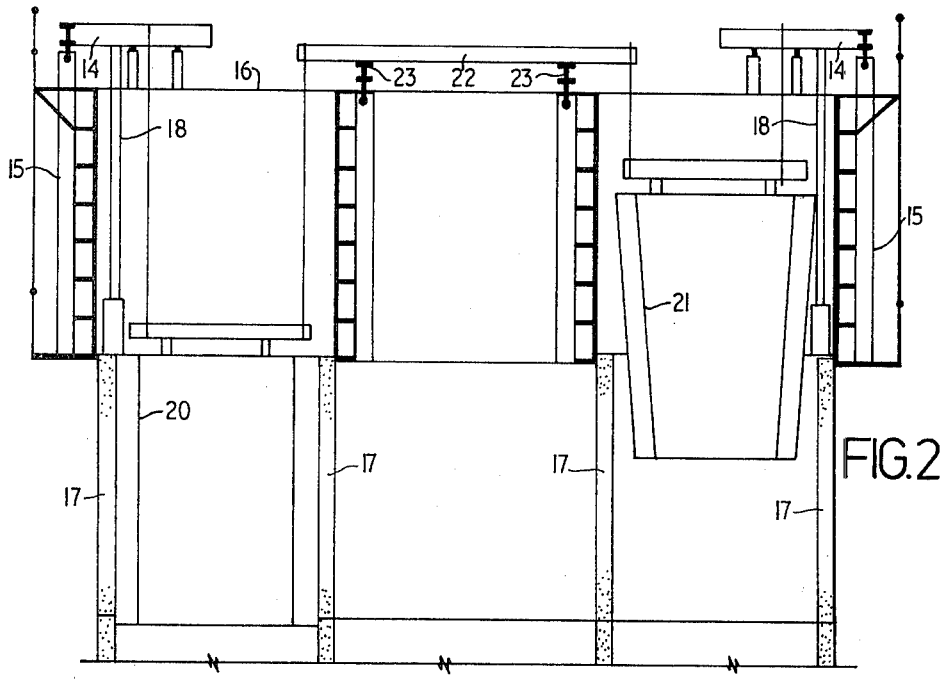
FIG. 2 is a sectional elevation across the whole structure shown in FIG. 1 on line II—II, FIG. 3(*a*) to (*o*) are cross-sectional views on line III—III of FIG. 1 which serve to illustrate the various steps in the elevation of formwork in the construction of a building, FIGS. 4(*a*) to (f) are similar views illustrating the application of a different form of the invention and FIGS. 5(*a* ) to (*f*) are similar views illustrating the application of a third form of the invention.
Figure 3H:
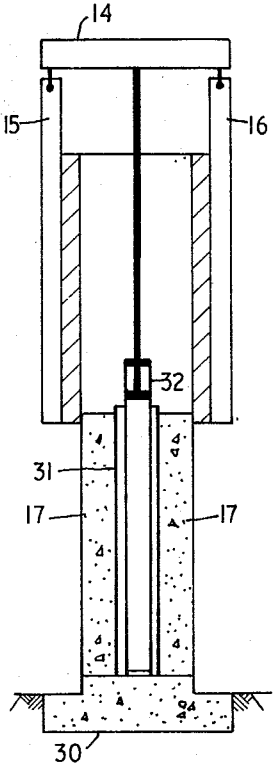
Figure 3G:
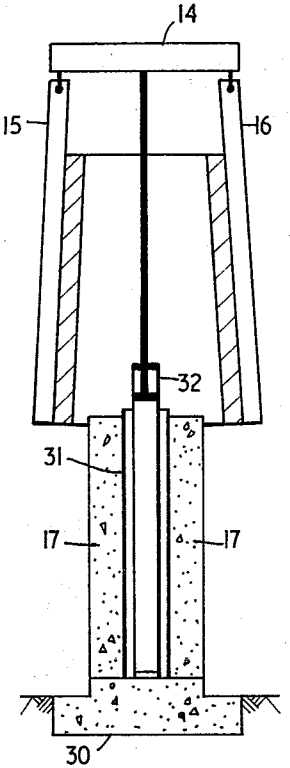
Figure 3F:
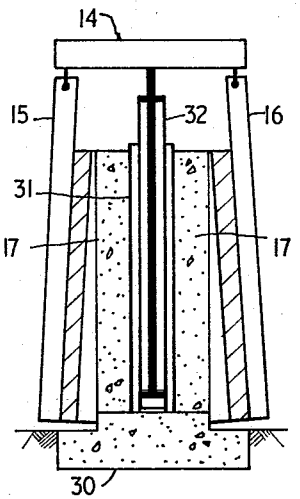
Figure 3E:
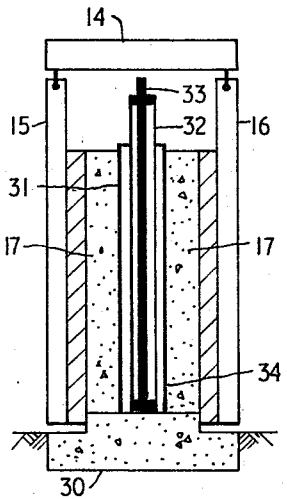
Figure 3L:
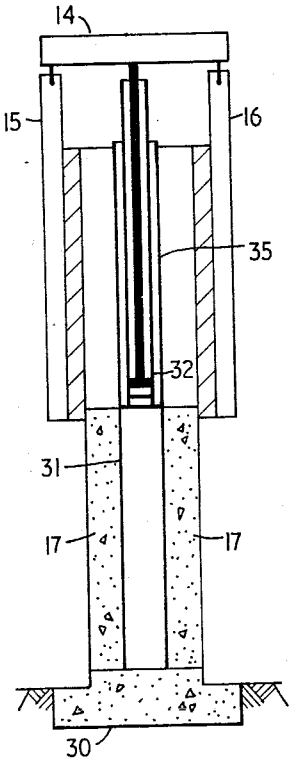
Figure 3K:
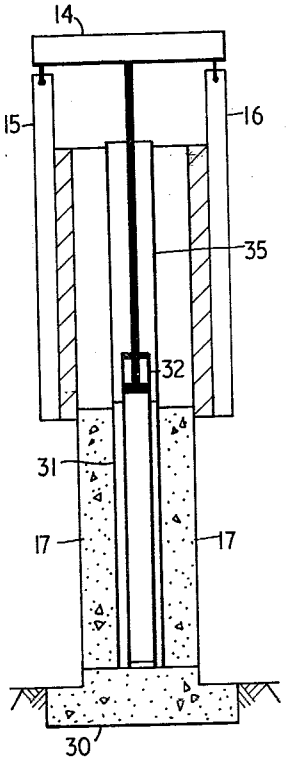
Figure 3J:
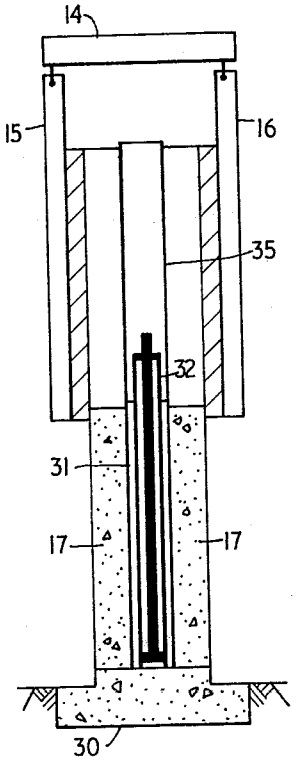
Figure 3I:
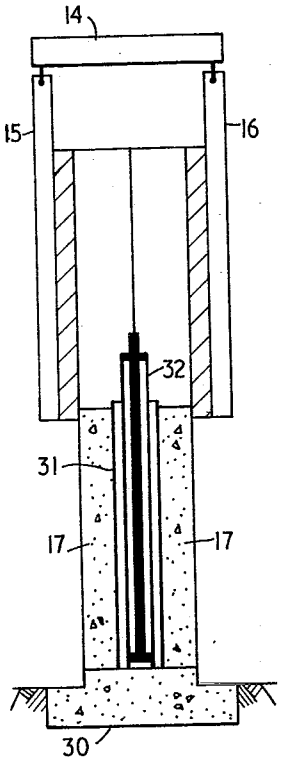
Figure 3O:
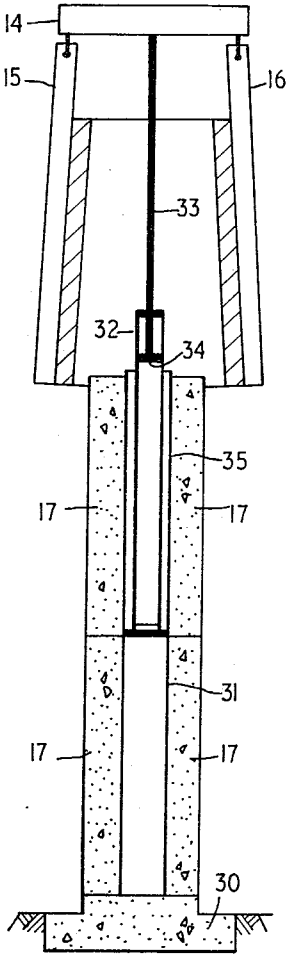
Figure 3N:
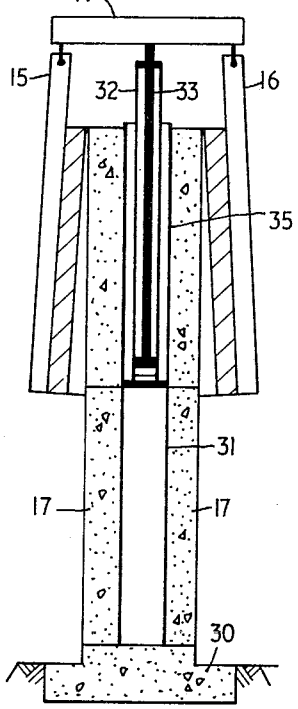
Figure 3M:
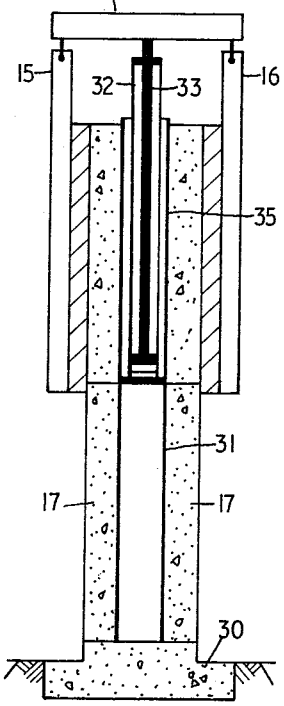
Figures 4A, 4B, 4C:
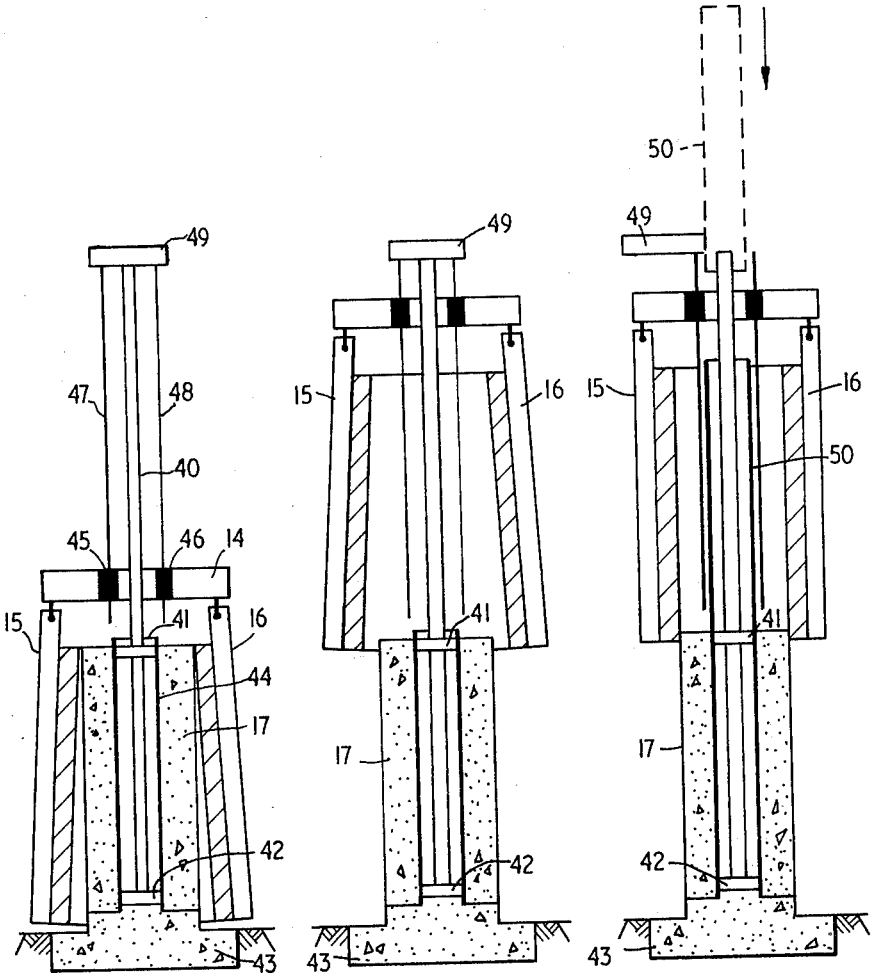
Figure 4D:
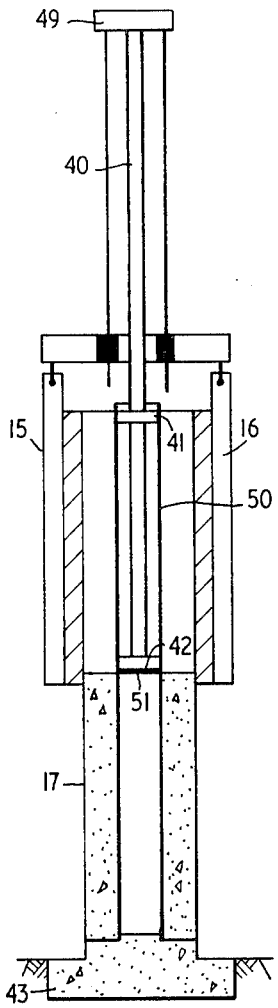
Figure 4E:
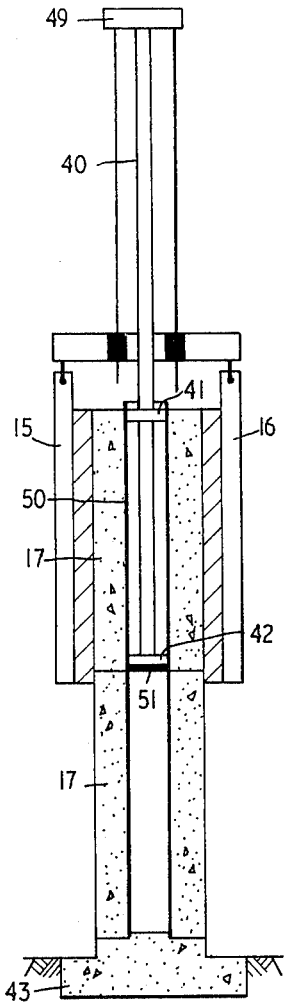
Figure 4F:
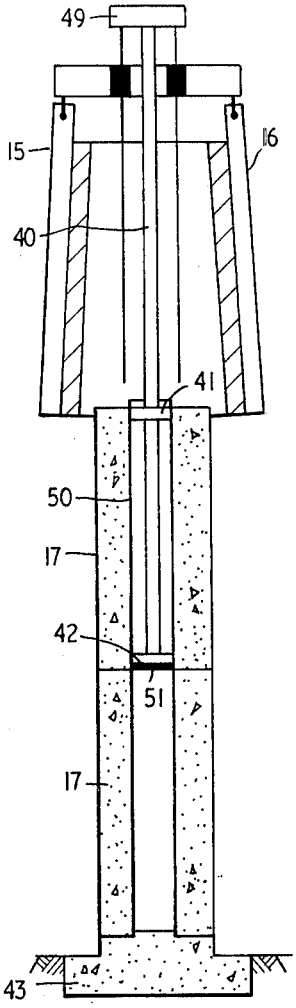
Figures 5A, 5B, 5C:
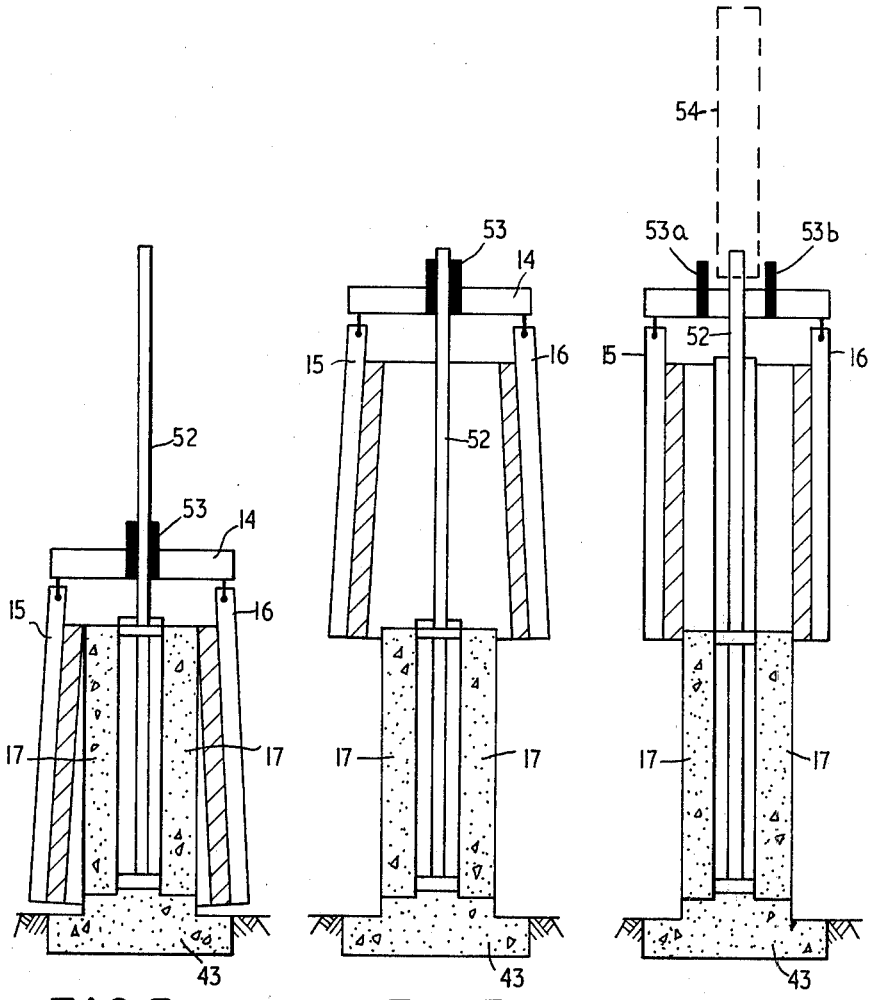
Figure 5D:
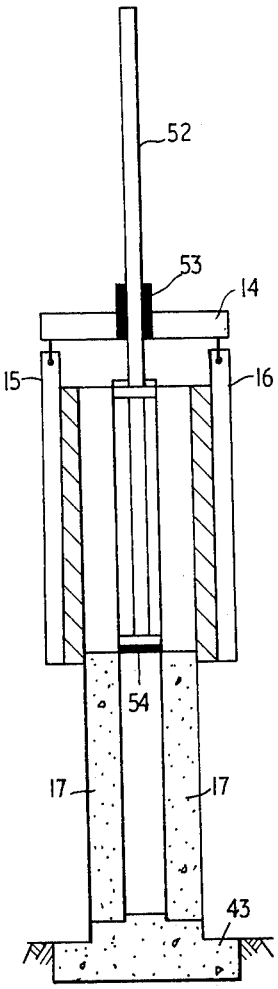
Figure 5E:
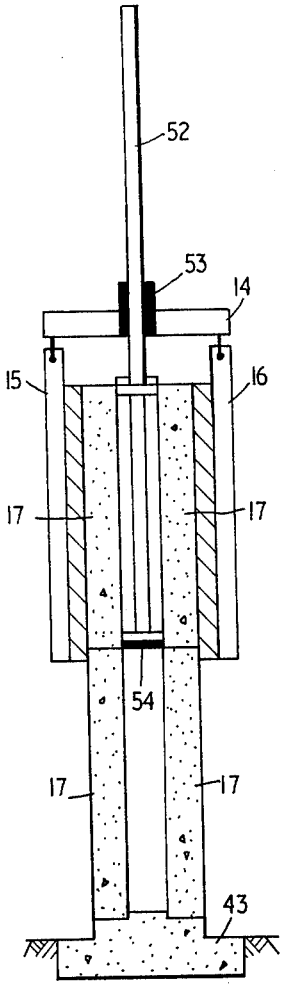
Figure 5F:
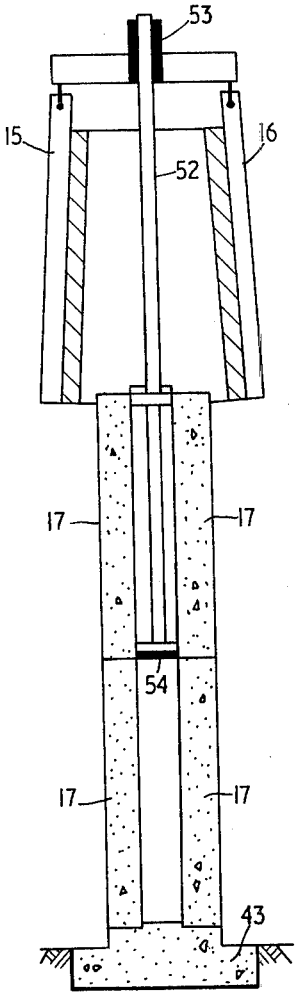

FIG. 2 gives a general idea of the site as seen in sectional elevation after the completion of one storey of concrete, the concrete walls 17 having been completed. Each yoke 14 is shown supported by a vertically extending member 18 and carries external forms 15 and 16, and internal forms 23. Two internal forms 20 and 21 are shown, supported from yokes 14 and beam 22, the latter being itself supported on structural shapes 23 spanning from one outer form 16 to another outer form 16. The internal form 21 is in the process of being elevated. The purpose of this figure is to give the general idea of the arrangement of the apparatus on the site.

In FIGS. 3(*a*) to (*o*) a sectional view of part of the formwork on the line III—III of FIG. is shown to illustrate the various steps in carrying out a preferred form of the invention. At the stage shown in FIG. 3(*a*) the footings 30 of the building have been laid down and the forms 15 and 16 are in position. It will be appreciated that in this view the internal form 20 is not seen. In FIG. 3(*b*) an asbestos cement tube or a tube, of any other suitable material, 31 has been placed in position so as to extend vertically on the footings 30 and in FIG. 3(*c*) concrete has been poured to form the walls 17. The yoke 14 is attached to the form 15 and 16 as shown in FIG. 3(*d*).

In FIG. 3(*e*) the vertically extending member indicated as 18 in FIG. 1 has been placed in position. In this form of the invention this consists of an outer cylinder 32, a piston 33 and a piston base 34 which elements together are arranged to constitute a double acting hydraulic cylinder having hydraulic pipe connections at either end. These, however have been omitted for clarity. If hydraulic fluid is admitted to the cylinder 32 below the piston base 34 the piston 33 will be elevated out of the cylinder 32, the length of the member then being in excess of the height of two storeys of the building (FIG. 3(*h*). When in that position (FIG. 3(*h*), if the piston 33 is anchored in some way and hydraulic fluid is then admitted at the top of the cylinder 32 above the piston base 34, this will have the effect of elevating the cylinder 32 to bring it to the position shown in FIG. 3(*l*).

In FIG. 3(*f*) the forms 15 and 16 have been stripped from the walls 17 and swung out about their upper hinged ends. Hydraulic fluid is then admitted below the piston base 34 to raise the piston 33 to the position shown in FIG. 3(*g*) carrying with it the yoke 14 and the forms 15 and 16, the lower ends of which are secured to and supported by the walls 17 in FIG. 3(*h*).

Hydraulic fluid is then pumped into the upper end of the cylinder 32 to retract the piston 33 to the position shown in FIG. 3(*i*). A second asbestos cement tube 35 is then placed on top of the tube 31 as shown in FIG. 3(*j*). The piston 33 is then elevated to the position shown in FIG. 3(*k*) and attached at its upper end to the yoke 14. Hydraulic fluid is then pumped into the upper end of the cylinder 32 which results in the cylinder being elevated to the position shown in FIG. 3(*l*) as explained above. Tube 32 is raised slightly to allow a support 36 to be placed on the tube 31 to support the lower end of the cylinder 32. A further storey of the walls 17 is then cast as shown in FIG. 3(*m*); the forms 15 and 16 are then stripped as shown in FIG. 3(*n*) and elevated to the position shown in FIG. 3(*o*) which corresponds to the position in the cycle of operations shown in FIG. 3(*g*). The procedure is continued until the walls are completed.

It should be made clear that all the external forms and some internal forms are lifted simultaneously by operation of all the vertically extending members 18 at the same time and that internal forms such as 20 and 21 are stripped, raised and relocated at appropriate times as the construction proceeds. The vertically extending members are supported in and by concrete previously cast in such a manner that they are maintained vertical.

FIGS. 4(*a*) to (*f*) show a second form of the invention in which the vertically extending members each consist of a steel pipe 40 the height of which corresponds to somewhat more than two storeys of the building structure and which is provided along its length with shaped collars 41 and 42.

At the stage shown in FIG. 4(*a*) the footings 43 of the building have been laid down, the internal forms such as 20 and 21 of FIG. 2 have been set in place and the first storey of the concrete walls 17 has been poured around an asbestos cement tube 44 as described in connection with FIG. 3. Forms 15 and 16 carried by the yoke 14 have been stripped from the concrete walls 17 and are about to be raised. In this embodiment, instead of utilising a vertically extending member in the form of a double acting hydraulic ram which in its extended position is slightly greater in length than the height of two storeys of the building, an arrangement of a vertically extending member of fixed length and climbing jacks 45 and 46 mounted on the yoke 14 is used in combination with the rods 47 and 48 joined at their upper ends by the yoke 49. In order to elevate the forms 15 and 16 to the position in FIG. 4(*b*), the jacks 45 and 46 are caused to climb up the rods 47 and 48 to the position shown in FIG. 4(*b*). As indicated in FIG. 4(*c*), after securing the forms 15 and 16 to the upper ends of the walls 17 the yoke 49 is displaced sideways to permit a second asbestos cement tube 50 to be placed around the member 40 as shown in FIG. 4(*c*).

The member 40 is then elevated to the position shown in FIG. 4(*d*) by operating the jacks 45 and 46 in the reverse direction to elevate the yoke 49 to which the member 40 has been attached. A suitable support 51 is then inserted under the collar 42 which acts to support the member 40 on the tube 44. Concrete is then poured to complete the next storey of the walls 17 as indicated in FIG. 4(*e*) completing the cycle of operation. The formwork is then elevated a further storey as shown in FIG. 4(*f*) to a position corresponding to that shown in FIG. 4(*b*) and the cycle of operations is repeated.

FIG. 5 illustrates a further form of the invention which is similar to that illustrated in FIG. 4 but differs from it in that the vertically extending member 52 has its upper portion modified so as to be suitable to be engaged by a jack 53 carried by the yoke 14. In FIG. 5(*b*) the yoke 14 and forms 15 and 16 are shown elevated to the top of the member 52 by the action of the jack 53.

The jack 53 is made in two parts 53*a* and 53*b* which are movable on the yoke 14 in the manner indicated in FIG. 5(*c*) to enable an asbestos cement tube 54 to be inserted in position. Thereafter the jack 53 is used to elevate the member 52 as shown in FIG. 5(*d*) the lower end of the member then being supported by a support 54. Concrete for the second storey of the walls 17 is then poured as indicated in FIG. 5(*e*) and the cycle of operations recommended.

The apparatus and methods of carrying out the invention as described above are given by way of example only, as is the fact that the invention has been described as being applied in connection with the construction of the core of a reinforced concrete building. It could in fact be applied to the construction of almost any vertically extending reinforced concrete structure.

In some structures such as, for example, a wall, the designation of certain forms as outer forms and others as inner forms becomes arbitrary.

While in the embodiments of the invention described the walls are poured storey by storey in a quasi continuous manner, the procedure may be interrupted after a storey of walls is completed by raising all forms above the level of the walls to allow a concrete floor to be formed up and poured after which the forms are lowered onto the floor and pouring of concrete for the walls is continued.

In the embodiments described some of the inner forms are raised by means of the vertically extending members, it is however within the scope of the invention to raise all or none of the inner forms in this manner.

I claim:

1. A method of erecting a concrete structure utilizing climbing formwork, said method comprising the steps of: constructing footings for said structure; erecting inner and outer forms on said footings; supporting vertically extending open tubular support means on said footings between said inner and outer forms; casting a first storey of said structure between said inner and outer forms and around said open tubular support means; inserting, into said open tubular support means, respective double-acting hydraulic jacks, each including a cylinder supported on said footings, a piston movable in the cylinder and an upwardly extending piston rod secured to the piston, with each jack having an extended height exceeding the height of two storeys of said structure; attaching the outer forms to means carried on the upper ends of said piston rods, after the concrete of said first storey has sufficiently set, extending said jacks to take the weight of said forms; stripping said forms from said first storey of said structure; further extending said jacks to elevate said outer forms into positions for pouring the next storey of said structure; supporting said outer forms on the set concrete of the previously cast story of said structure; elevating said inner forms into position for pouring the next storey of said structure; supporting said piston rods on said outer forms while operating said jacks to elevate said cylinders a height corresponding to one storey of said structure; supporting said cylinders in the elevated position; positioning further vertically extending open tubular support means on said first-mentioned tubular support means coaxially of the latter; pouring concrete between said inner and outer forms and around said further open tubular support means, for the next storey of said structure; and repeating the foregoing steps for each storey of the structure.

2. A method as claimed in claim 1, including the steps of, after pouring concrete for a story of said structure and allowing the same to set, raising all forms; constructing a reinforced concrete floor on the completed and set walls of said structure; thereafter lowering said forms onto the reinforced concrete floor after the latter has been set; and repeating said steps for each storey of said structure.

* * * * *